US009136633B2

(12) United States Patent
Dods et al.

(10) Patent No.: US 9,136,633 B2
(45) Date of Patent: Sep. 15, 2015

(54) TERMINAL RETAINER FOR PLUG OR RECEPTACLE OF MODULAR WIRING SYSTEM

(71) Applicant: 8521000 Canada Limited, Fitzroy Harbour (CA)

(72) Inventors: Stephen Dods, Ottawa (CA); Andrew Dods, Fitzroy Harbour (CA); Terry Dods, Ottawa (CA); Dana Budau, Carp (CA); Martin Cloake, Ottawa (CA); Jacques Sibille, L'Ange Gardien (CA); Calvin Todd Pearce, Ottawa (CA)

(73) Assignee: 8521000 Canada Limited (CA)

( * ) Notice: Subject to any disclaimer, the term of this patent is extended or adjusted under 35 U.S.C. 154(b) by 0 days.

(21) Appl. No.: 14/279,787

(22) Filed: May 16, 2014

(65) Prior Publication Data

US 2015/0072569 A1 Mar. 12, 2015

Related U.S. Application Data

(60) Provisional application No. 61/823,977, filed on May 16, 2013.

(51) Int. Cl.

| | |
|---|---|
| ***H01R 13/14*** | (2006.01) |
| ***H01R 13/42*** | (2006.01) |
| ***H01R 13/642*** | (2006.01) |

(52) U.S. Cl.
CPC ..... *H01R 13/42* (2013.01); *H01R 13/642* (2013.01)

(58) Field of Classification Search
CPC ..... H01R 13/14; H01R 13/40; H01R 43/48; H01R 4/18; H01R 13/42; H01R 13/642; H02G 3/00
USPC ..... 439/752, 752.5, 695, 686, 879
See application file for complete search history.

(56) References Cited

U.S. PATENT DOCUMENTS

| | | | | |
|---|---|---|---|---|
| 3,273,105 | A * | 9/1966 | Klassen | 439/687 |
| 4,194,805 | A * | 3/1980 | Ayer et al. | 439/465 |
| 4,775,802 | A | 10/1988 | Dods | |
| 7,553,171 | B2 * | 6/2009 | Wang et al. | 439/106 |

* cited by examiner

*Primary Examiner* — Abdullah Riyami
*Assistant Examiner* — Nader J Alhawamdeh

(57) ABSTRACT

A terminal retainer for a modular wiring system includes a first retainer component made of an electrically insulating material, an internal post protruding from an inner surface of the first retainer component, a terminal made of an electrically conductive material and adapted to be electrically joined to an electrical wire, the terminal having a hole for mounting the terminal on the post, and a second retainer component also made of the electrically insulating material, the second retainer component being adapted to attach to the first retainer component to form the terminal retainer.

7 Claims, 3 Drawing Sheets

TERMINAL RETAINER FOR PLUG OR RECEPTACLE OF MODULAR WIRING SYSTEM

CROSS-REFERENCE TO RELATED APPLICATIONS

This application claims priority from U.S. Provisional Patent Application 61/823,977, filed 16 May 2013.

TECHNICAL FIELD

The present technology relates generally to electrical plugs and receptacles and in particular to plugs and receptacles for modular wiring systems.

BACKGROUND

Buildings intended for commercial or retail office space are generally constructed in a manner which permits the sectioning off of selected floor areas according to the wishes of a tenant to provide individual offices in accordance with an office floor plan designed by or for the individual tenant. Since the tenancy on any particular floor of an office building might be expected to change every few years or so, it is important that the lighting installation of each floor of the building be of a type which is relatively easily modified and rewired so that individual offices, conference rooms, kitchen and reception areas, etc. can be sectioned off and provided with their own overhead lights and light switch.

For this reason, it is advantageous to use a modular wiring system made up of separate interconnecting components for wiring together the light fixtures and other electrical components of an office or retail space. The more simple the design and construction of the wiring components, the more advantageous is the system. Likewise, the more simple the method of wiring together the components, the more advantageous is the system. However, a simple design and wiring method alone are not the only objectives of an efficient wiring system; it is also desirable that the components of the wiring system be easy to work with in that they be manageable and "foolproof" (i.e. designed so that only designated components of the system are capable of being connected to other components in accordance with the intended wiring method).

Modular wiring systems may be used for wiring light fixtures, control systems, devices, switches, panels and other electrical equipment in both residential and commercial construction. Modular "plug-and-play" components reduce installation time and enable quick, safe and cost-effective alterations. Pre-terminated connections provide an economical solution for flexible environments, tenant fit-up, retail display or renovations. Modular wiring systems dramatically reduce labour costs compared to hard wiring methods.

A modular wiring system is disclosed in U.S. Pat. No. 4,775,802, which is hereby incorporated in its entirety.

Further improvements on this and other known modular wiring technologies remain highly desirable.

SUMMARY

In general, the present invention provides a terminal retainer for a plug or receptacle of a modular wiring system. The terminal retainer has two components that are attached to one another to retain the terminal, e.g. the pin connector or pin socket. The terminal retainer is then inserted (installed) in a retainer-receiving holder of the plug or receptacle.

Thus, an aspect of the present invention is a terminal retainer for a modular wiring system. The terminal retainer includes a first retainer component made of an electrically insulating material, an internal post protruding from an inner surface of the first retainer component, a terminal made of an electrically conductive material and adapted to be electrically joined to an electrical wire, the terminal having a hole for mounting the terminal on the post, and a second retainer component also made of the electrically insulating material, the second retainer component being adapted to attach to the first retainer component to form the terminal retainer.

Another aspect of the present invention is a plug having a plug body having a retainer-receiving holder and a terminal retainer (as described above) installed in the holder.

Another aspect of the present is a receptacle having a receptacle body having a retainer-receiving holder and a terminal retainer (as described above) installed in the holder.

Yet another aspect of the present invention is a method of assembling a plug or receptacle for a modular wiring system. The method entails providing a first retainer component made of an electrically insulating material, the first retainer component having an inner surface from which protrudes an internal post, mounting on the post a terminal made of an electrically conductive material, crimping an electrical wire to the terminal, attaching a second retainer component also made of the electrically insulating material to the first retainer component, and installing the terminal retainer in a retainer-receiving holder of the plug or receptacle.

Other aspects of the invention are described below in relation to the accompanying drawings.

BRIEF DESCRIPTION OF THE DRAWINGS

Further features and advantages of the present technology will become apparent from the following detailed description, taken in combination with the appended drawings, in which.

It will be noted that throughout the appended drawings, like features are identified by like reference numerals.

DETAILED DESCRIPTION

The embodiments of the present invention provide, in general, a terminal retainer either for a plug of a modular wiring system or for a receptacle of a modular wiring system. The terminal retainer has first and second retainer components that come together to retain the terminal, e.g. the pin connector or pin socket. The terminal retainer is then inserted (installed) in a retainer-receiving holder of the plug or receptacle.

For the purposes of this specification, the terminal may be a connector pin (male terminal or male connector) or a pin socket (female terminal or female connector). The connector pin may be part of a (male) plug or a (male) receptacle. The pin socket may be part of a (female) plug or a (female) receptacle. The connector pin itself may have different shapes, e.g. cylindrical prongs, flat blades, etc. Likewise, the pin sockets may have corresponding shapes to accommodate any shape of prongs or blades as the case may be.

Figure 1:
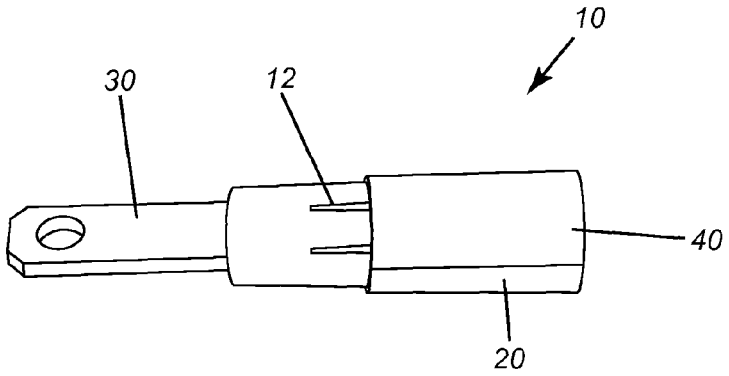
FIG. 1 is an isometric view of a terminal retainer in accordance with one embodiment of the present invention.

FIG. 1 illustrates a terminal retainer generally designated by reference numeral 10 which is designed for use in a modular wiring system. The terminal retainer 10 has a first retainer component 20 made of an electrically insulating material, which may be made by, for example, molding any suitable polymer such as a thermoplastic like acrylonitrile butadiene styrene (ABS) or polyvinyl chloride (PVC).

Figure 2:
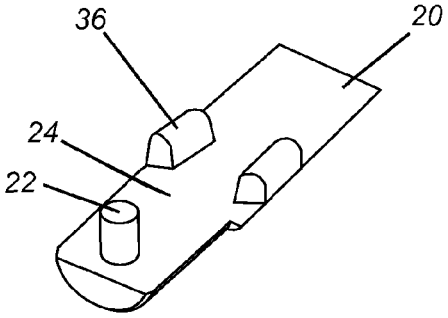
FIG. 2 is an isometric view of a first retainer component.

As illustrated in FIG. 2, an internal post 22 protrudes from an inner surface 24 of the first retainer component. The post illustrated in FIG. 2 is circular in cross section although, in other variants, the post may have any other cross-sectional profile, e.g. square, rectangle, triangle, pentagon, hexagon, octagon, semicircular, etc, or even an irregular or asymmetrical shape. A terminal 30 made of an electrically conductive material (e.g. copper, copper alloy, etc.) is adapted to be electrically joined (e.g. by crimping) to an electrical wire (not shown). The terminal has a hole 32 for mounting the terminal on the post 22. The hole is circular in FIG. 2 (to match the post) but any other shape of hole could be employed provided it matches the post. The terminal abuts a support 36 or stop to prevent the terminal from rotating inside the retainer.

The terminal retainer 10 also includes a second retainer component 40 which is also made of the electrically insulating material. The second retainer component 40 is adapted to attach to the first retainer component to form the terminal retainer. The first and second retainer components may be press-fitted or snapped together, bonded by chemical adhesive, ultrasonically welded, or welded using thermoplastic welding techniques, or any combination thereof, etc.

Figure 3:
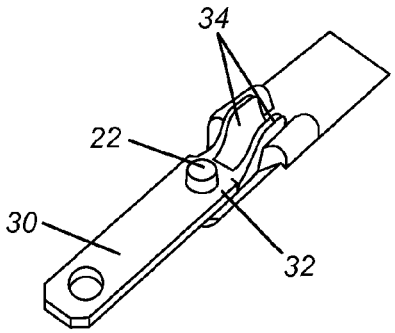
FIG. 3 is an isometric view of a flat blade connector on the post of the first retainer component.

As illustrated in FIG. 3, the terminal 30 has crimping wings 34 disposed on a rearward portion 36 of the terminal for crimping the terminal to the wire. The terminal retainer includes an aperture for the wire to extend out of the terminal retainer. The terminal 30 has crimping wings (34) for the intent of crimping (or other method of attachment) wire to the terminal. This wire cane be solid, stranded type, copper , aluminum and be any acceptable type (such as T-90, R-90, TW-75 or any other). The crimping wing, or any other method of attachment, shall accept any size wire (from #22 AWG to #6 AWG or similar sizes). The wire that is attached to the terminal by crimping or other means shall be on any number of wires, not all have to be used. This wire shall be one of any amount of wires as part of a cable. The cable can be any acceptable type, such as : Armored cable, Non-metallic sheathed cable, Rubber (thermoset) insulated cable, Nylon jacketed thermo plastic-insulated cable, Aluminum sheathed cable, Mineral insulate cable, Neutral supported cable, Extra-low-voltage cable, Extra-low-voltage control cable, Under carpet communications wire and cable, Fire alarm and signal cable or any other.

In the embodiment depicted in FIG. 3, the terminal is a flat blade pin connector. The inner surface is flat, as shown in FIG. 2, in order to accommodate such a terminal.

Figure 4:
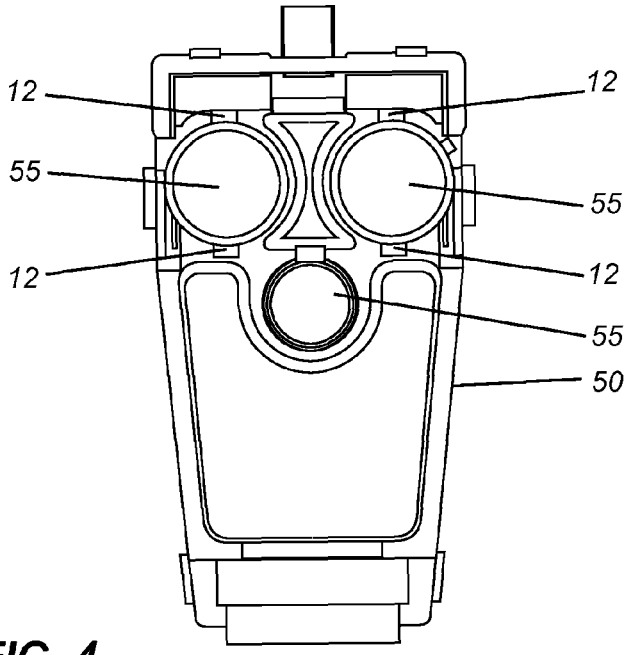
FIG. 4 is an isometric view of a plug showing the retainer-receiving holders into which the retainers are inserted.

FIG. 4 illustrates a plug 50 having retainer-receiving holders 55 into which the retainers 10 are inserted to assemble the plug. The retainer-receiving holders are sockets shaped to match the terminal retainers. In this embodiment, the holders are circular in cross-section to accommodate the cylindrically-shaped body of the terminal retainers. In most embodiments, it is advantageous to design and manufacture the terminal retainers and holders with appropriate tolerances so that the retainers can be finger-pressed into the holders for manual or robotic assembly. For terminal retainers having a rounded body such as the ones shown in the illustrations, it is useful to provide a plurality of anti-rotation ribs disposed on the outer surface of the terminal retainer for preventing rotation of the terminal retainer when installed inside a respective round retainer-receiving holder of a plug or receptacle. These longitudinally aligned ribs interact with longitudinally aligned ridges protruding from the round inner surface of the holder to lock the retainer in one angular orientation and thus to prevent the retainer from rotating inside its respective holder.

Figure 5:
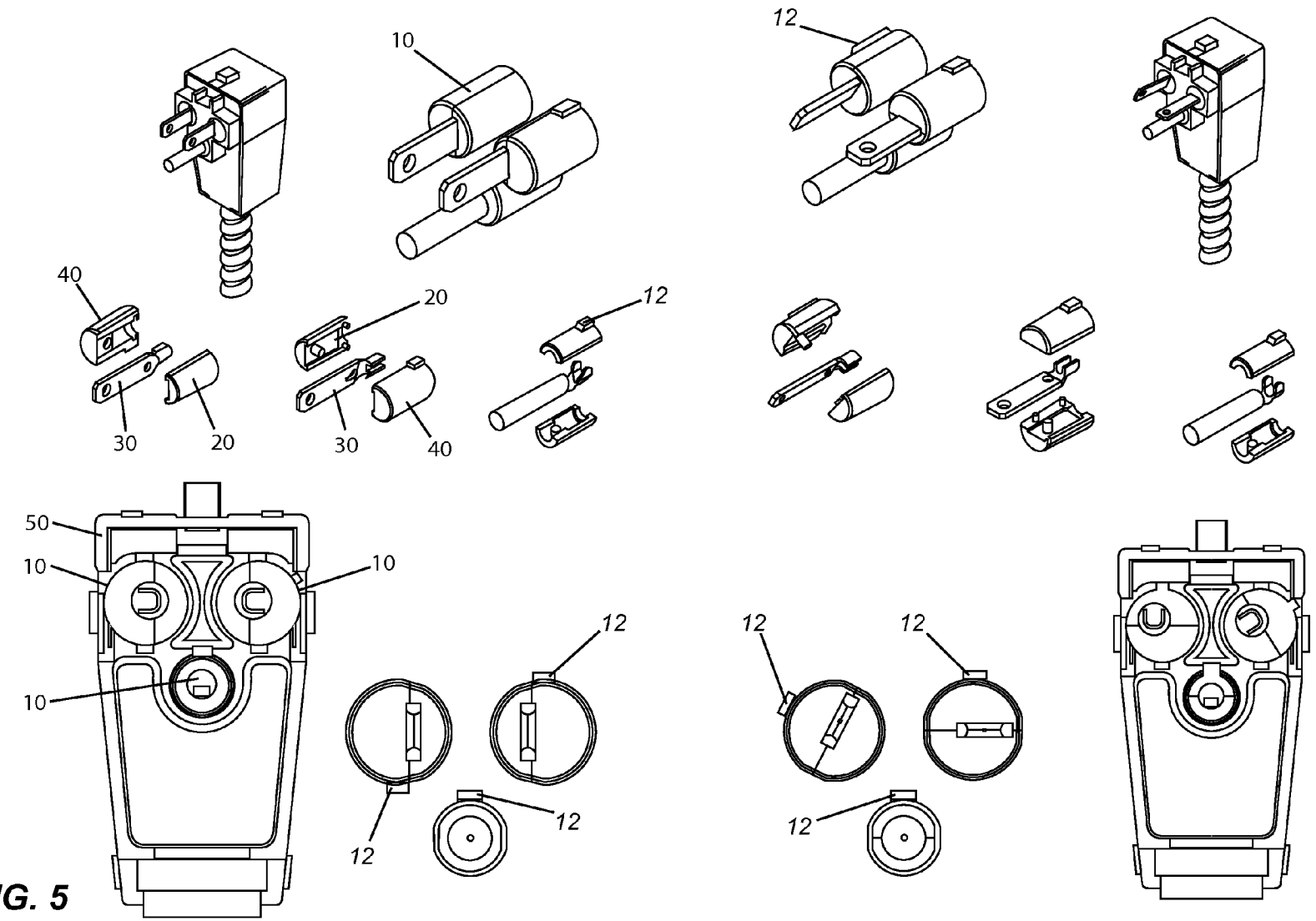
FIG. 5 is an isometric view of a plug with the terminal retainers installed in the retainer-receiving holders.

FIG. 5 is an isometric view of the plug 50 with the terminal retainers 10 installed in the retainer-receiving holders 55. Although in the illustrated embodiment the plug has three pins, it will be appreciated that this technology may be applied to any other plug or receptacle having any other configuration or number of pins. It will also be understood that in some cases, differently sized or shaped terminal retainers may be installed in the same plug or receptacle.

Figure 6:
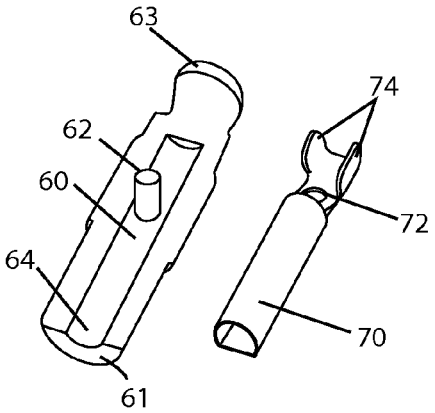
FIG. 6 is an isometric view of a pin socket and the first retainer component of a terminal retainer in accordance with another embodiment of the present invention.

In another embodiment, the terminal is a round pin socket, as shown by way of example in FIG. 6. This same figure also shows the first retainer component 60 and that the inner surface 64 of this first retainer component 60 is curved to accommodate the tubular shape of the pin socket. Protruding from the inner surface 64 is a post 62. This post may be rectangular as shown or any other shape.

Figure 7:
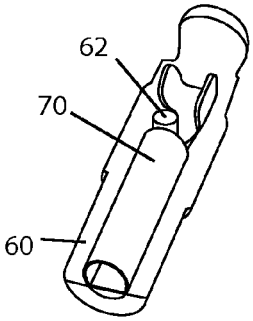
FIG. 7 is an isometric view of the pin socket mounted on the first retainer component.

As shown in FIG. 6, the post 62 is located closer to the midpoint of the first retainer component 60 than to the front end 61 or to the rear end 63 of the first retainer component. This is in contrast to the post 22 shown in FIG. 2 in which the post 22 was located closer to the front end than to the midpoint of the first terminal component. The terminal 70 includes a hole 72 adapted (i.e. shaped and dimensioned) to be fitted over the post 62 as shown by way of example in FIG. 7. The terminal 70 includes crimping wings 74 for crimping a wire to the terminal. The second terminal component 80 is affixed or attached to the first terminal component to form the assembled terminal retainer 90 shown in FIG. 8.

Figure 8:
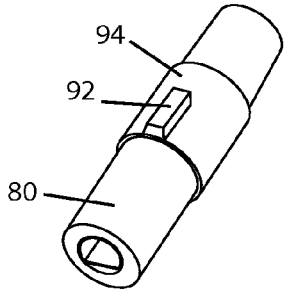
FIG. 8 is an isometric view of the assembled terminal retainer.

In one embodiment, the terminal retainer 90 has a stepped cylindrical shape as shown in FIG. 8.

In one embodiment, the terminal retainer comprises a plurality of anti-rotation ribs 92 disposed on the outer surface 94 of the terminal retainer for interlocking with ridges inside the holders to thereby prevent rotation of the terminal retainer when installed inside a respective retainer-receiving holder of a plug or receptacle.

Figure 9:
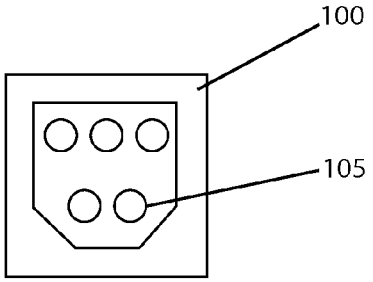
FIG. 9 is a front view of a receptacle having retainer-receiving holders into which the terminal retainers are inserted.

FIG. 9 depicts a receptacle 100 having a plurality of retainer-receiving holders 105 into which the terminal retainers 90 are inserted. In this example embodiment, the receptacle has five sockets although the number of sockets and their configuration may vary.

Figure 10:
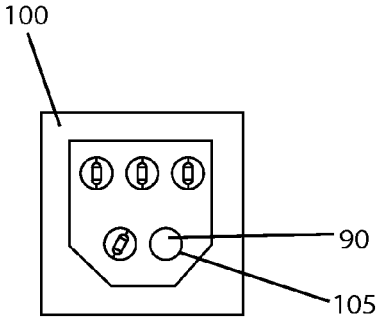
FIG. 10 is a front view of the receptacle with the terminal retainers installed in the retainer-receiving holders.
Figure 11:
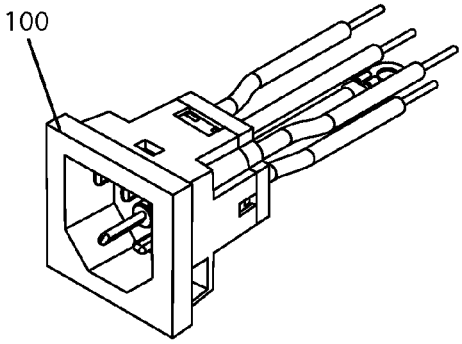
FIG. 11 is an isometric view of the receptacle of FIG. 10.
Figure 12:
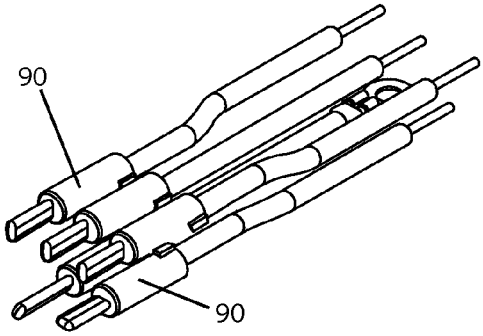
FIG. 12 is an isometric view of a group of terminal retainers, terminals and wires for insertion into the receptacle.

FIG. 10 is an isometric view of the receptacle 100 with five terminal retainers 90 installed in each of the five retainer-receiving holders 105. FIG. 11 is an isometric view of the receptacle 100 of FIG. 10. FIG. 12 is an isometric view of a group of terminal retainers 90 with their respective terminals and wires. The terminal retainers 90 are inserted into the receptacle 100.

One main advantage of this modular design is that it facilitates assembly by permitting terminal retainers that retain different types of terminals (e.g. prongs, blades, etc.) to be used interchangeably to create different types of plugs and receptacles. It also enables terminal retainers to be removed and replaced. For example, in an assembly operation, plug bodies each having a certain number and configuration of empty terminal-receiving holders (sockets) can be used for assembling different types of plug by simply inserting terminal retainers having the desired type of terminal. Thus, the same plug bodies can be converted into male plugs with blade terminals, male plugs with cylindrical prongs, male plugs with any combination of blades and prongs, female plugs with blade sockets, female plugs with prong sockets, or female plugs with any combination of blade sockets and prong sockets. Similarly, different types of receptacles may be assembled by inserting terminal retainers having different terminals into a receptacle body having commonly sized retainer-receiving holders (socket). This technology thus provides tremendous flexibility in the manufacturing process.

Another aspect of the inventive subject matter of this disclosure is a method for assembling a plug or a receptacle of a modular wiring system. The method entails providing a first retainer component made of an electrically insulating material, the first retainer component having an inner surface from which protrudes an internal post, mounting on the post a terminal made of an electrically conductive material, crimping an electrical wire to the terminal, attaching a second retainer component also made of the electrically insulating material to the first retainer component, and installing the terminal retainer in a retainer-receiving holder of the plug or receptacle.

This new technology has been described in terms of specific implementations and configurations which are intended to be exemplary only. Persons of ordinary skill in the art will appreciate that many obvious variations, refinements and modifications may be made without departing from the inventive concepts presented in this application. The scope of the exclusive right sought by the Applicant(s) is therefore intended to be limited solely by the appended claims.

The invention claimed is:

1. A terminal retainer for a modular wiring system, the terminal retainer comprising:

a first retainer component made of an electrically insulating material;

an internal post protruding from an inner surface of the first retainer component;

a terminal made of an electrically conductive material and adapted to be electrically joined to an electrical wire, the terminal having a hole for mounting the terminal on the post; and a second retainer component also made of the electrically insulating material, the second retainer component being adapted to attach to the first retainer component to form the terminal retainer.

2. The terminal retainer as claimed in claim 1 wherein the terminal has crimping wings disposed on a rearward portion of the terminal for crimping the terminal to the wire, and wherein the terminal retainer comprises an aperture for the wire to extend out of the terminal retainer.

3. The terminal retainer as claimed in claim 1 wherein the terminal is a flat blade pin connector and wherein the inner surface is flat.

4. The terminal retainer as claimed in claim 1 wherein the terminal is a round pin socket and wherein the inner surface is curved.

5. The terminal retainer as claimed in claim 1 comprising a stepped cylindrical shape.

6. The terminal retainer as claimed in claim 5 comprising a plurality of anti-rotation ribs disposed on the outer surface of the terminal retainer for preventing rotation of the terminal retainer when installed inside a respective retainer-receiving holder of a plug or receptacle.

7. A method for assembling a plug or receptacle for a modular wiring system, the method comprising:

providing a first retainer component made of an electrically insulating material, the first retainer component having an inner surface from which protrudes an internal post;

mounting on the post a terminal made of an electrically conductive material;

crimping an electrical wire to the terminal;

attaching a second retainer component also made of the electrically insulating material to the first retainer component; and installing the terminal retainer in a retainer-receiving holder of the plug or receptacle.

* * * * *